US005353560A

United States Patent [19]

Heydon

[11] Patent Number: 5,353,560

[45] Date of Patent: Oct. 11, 1994

[54] BUILDING STRUCTURE & METHOD OF USE

[75] Inventor: John J. Heydon, Big Bear Lake, Calif.

[73] Assignee: Heydon Building Systems International, Limited, London, United Kingdom

[21] Appl. No.: 897,909

[22] Filed: Jun. 12, 1992

[51] Int. Cl.[5] ..... E04B 2/00

[52] U.S. Cl. ..... 52/281; 52/241; 52/243; 52/270; 52/284; 52/474; 52/592.1

[58] Field of Search ..... 52/290, 243.1, 243, 52/241, 239, 238.1, 763, 779, 778, 79.9, 79.12, 264, 270, 271, 272, 281, 284, 474, 475, 593, 595, 592.1

[56] References Cited

U.S. PATENT DOCUMENTS

| | | | |
|---|---|---|---|
| 634,562 | 10/1899 | Pagnon | 52/595 |
| 710,830 | 10/1902 | Zimmerman et al. | 52/779 X |
| 1,056,810 | 3/1913 | McDonald . | |
| 1,900,767 | 3/1933 | Ryan . | |
| 1,970,414 | 8/1934 | Brown | 52/779 X |
| 2,114,388 | 4/1938 | Killion . | |
| 2,249,203 | 7/1941 | Guignon | 52/272 |
| 2,275,109 | 3/1942 | McGee | 52/290 X |
| 2,505,902 | 5/1950 | Madger | 52/778 |
| 2,856,039 | 10/1958 | Hawkinson | 52/779 X |
| 2,883,852 | 4/1959 | Midby | 52/761 X |
| 2,966,708 | 1/1961 | Freeman, Jr. | 52/295 |
| 3,120,031 | 2/1964 | Boshnack . | |
| 3,160,280 | 12/1964 | Burch | 52/290 X |
| 3,343,314 | 9/1967 | Smith | 52/270 X |
| 3,410,044 | 12/1968 | Moog . | |
| 3,411,252 | 11/1968 | Boyle, Jr. | 52/290 X |
| 3,420,023 | 1/1969 | Gregori | 52/241 X |
| 3,733,755 | 5/1973 | Butler | 52/241 X |
| 3,927,498 | 12/1975 | Benedetti | 52/236 |
| 4,633,634 | 1/1987 | Nemmer et al. | 52/474 |
| 4,641,468 | 2/1987 | Slater | 52/309.4 |
| 4,672,785 | 6/1987 | Salvo | 52/241 |
| 4,774,794 | 10/1988 | Grieb | 52/593 X |
| 4,833,855 | 5/1989 | Winter | 52/592 |
| 4,854,096 | 8/1989 | Smolik | 52/241 |
| 4,981,003 | 1/1991 | McCarthy . | |
| 5,003,742 | 4/1991 | Dettbarn | 52/763 X |
| 5,203,132 | 4/1993 | Smolik | 52/290 X |

FOREIGN PATENT DOCUMENTS

| | | | |
|---|---|---|---|
| 1342059 | 9/1963 | France | 52/281 |

*Primary Examiner*—Carl D. Friedman
*Assistant Examiner*—Robert J. Canfield
*Attorney, Agent, or Firm*—Stetina and Brunda

[57] ABSTRACT

An improved building structure and method of use comprising separately fabricated floor, wall and ceiling structures capable of withstanding shear and seismic forces. The floor and ceiling structures of the present invention generally comprise I-beams having foam panels extending therebetween. The wall structure comprises an elongate track rigidly secured to the foundation structure of the building having a plurality of posts secured thereto. Disposed between the posts are a plurality of interlocking foam wall sections which encapsulate the posts of the wall structure. Attached to the top surfaces of the posts are header beams which serve as a support structure for the ceiling structure.

19 Claims, 8 Drawing Sheets

Fig. 12a
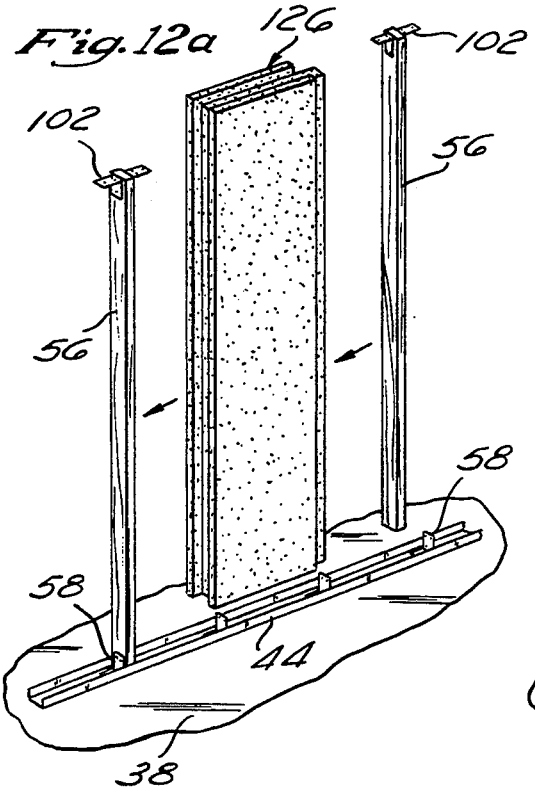
Fig. 12b
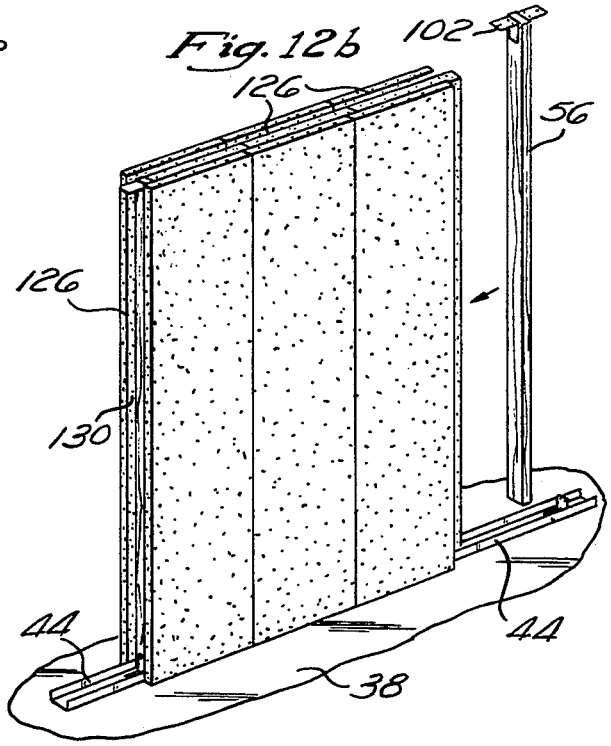
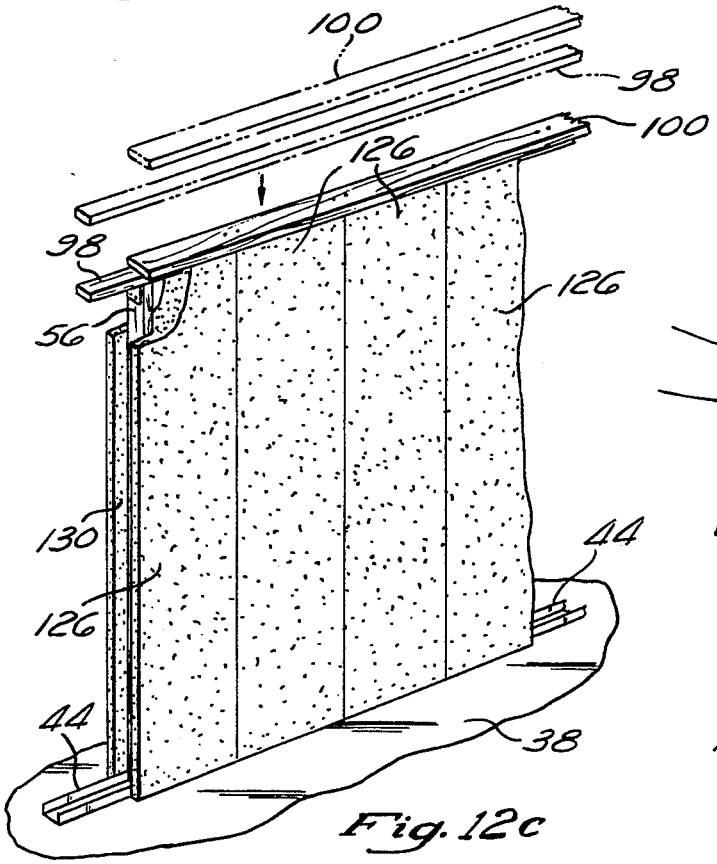
Fig. 12c
Fig. 13
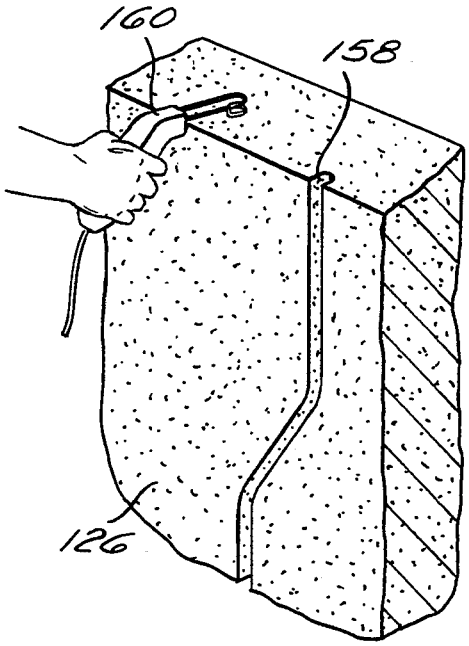

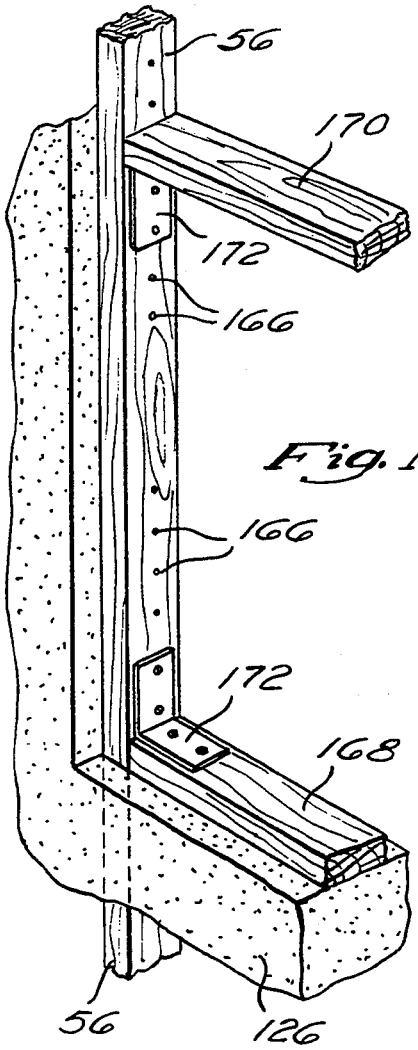
Fig. 14
Fig. 15
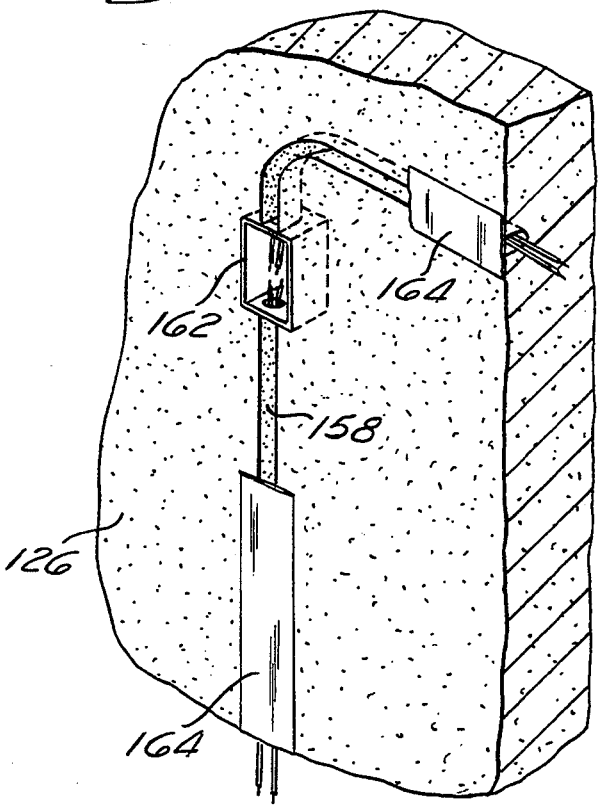
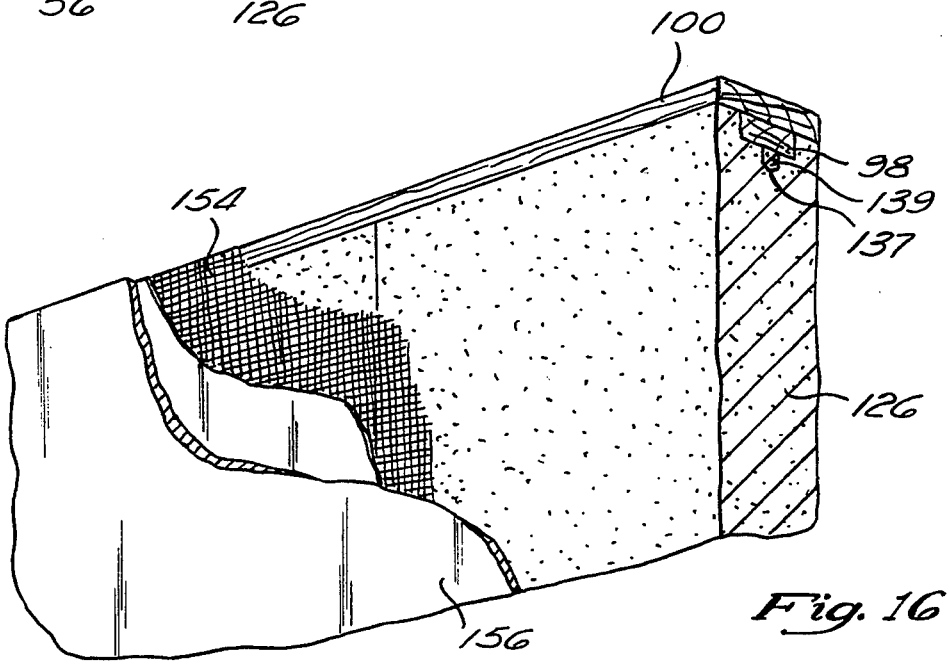
Fig. 16

BUILDING STRUCTURE & METHOD OF USE

FIELD OF THE INVENTION

The present invention relates generally to residential and commercial building structures and methods of forming the same, and more particularly to integrated wall, floor and ceiling structure formed of dimensionally stabile, pre-manufactured structural elements which are rapidly assembled in a manner resulting in a monolithic building structure.

BACKGROUND OF THE INVENTION

As is well known in the construction industry, builders of both residential and commercial building structures often face numerous difficulties during the construction process when utilizing forest products due to the lack of dimensional stability inherent with such products. In this respect, builders and craftsmen typically labor with the wood in an attempt to shape and fit the wooden components. However, often times the wood members twist, warp, split or crack during and subsequent to completion of the building project, thus impairing the quality and appearance of the building structure.

In relation to consumer products, modern material fabrication and assembly techniques have permitted manufacturers to hold close tolerances and have allowed for the development of mass production methods which have made it possible for consumers to enjoy a wide variety of products at affordable prices. However, such mass production methods have not successfully found their way into the construction industry on any significant scale. In this respect, billions of dollars have been spent by the construction industry in an attempt to adopt mass production methods to produce housing at more affordable prices. However, such efforts have generally fallen short due to the previously described dimensional instability of the wooden components typically utilized in construction, as well as the requirement of utilizing skilled labor to build the structures.

In recent years, some advancements have been introduced to wood construction through the use of reconstituting wood-based products with enhanced strength and dimensional stability. Other advancements in construction techniques have included the gradual conversion to steel, aluminum, plastic and other more stable building materials. Additionally, a number of attempts have been made to develop building wall structures which integrate framing and wall panels to form a composite wall. Certain ones of these prior art wall structures comprise an assembly of wall panels or wall bricks having hollow passages which form a series of interlocking vertical and horizontal passages in the assembly. These passages are filled with concrete, with or without rebar, to form structural framing, integral with the wall panel or bricks. Other types of prior art structures comprise reinforced composite wall panels that are interlocked to form a wall structure. A third type of prior art structure comprises an assembly of foam plastic forms that function as permanent concrete forms after the concrete has been poured between the forms.

Though many of the aforementioned prior art building materials and systems present improvements over the more traditional prior art materials and building systems, these materials and building systems possess certain inherent deficiencies which detract from their overall utility. In this respect, the aforementioned prior art wall structures, although reputed as being easy to assemble, often require substantial planning and piecemeal methods for forming windows and doors. Additionally, these prior art wall structures typically require a substantial amount of concrete which, though being widely available in some form, is not always of sufficient structural, load bearing capability. Additionally, the aforementioned materials and building methods are often deficient with regard to critical factors such as cost, material availability, capital requirements for manufacturing and transportation, technical skills both in the factory and field and ease of construction.

The present invention specifically addresses these and other deficiencies in the prior art by providing an integrated wall, floor and ceiling structures that employ no concrete and is fabricated from a minimum number of dimensionally stable, standardized framing elements and standard panels to form a resultant monolithic structure. In this respect, the present invention may be assembled with a minimum of tools and does not require employment of skilled labor, such as carpenters, brick layers and concrete pourers.

SUMMARY OF THE INVENTION

In accordance with a preferred embodiment of the present invention, there is provided an improved building system including dimensionally stable, wall, floor and ceiling structures. In the preferred embodiment, the wall structure comprises an elongate track having a generally U-shaped configuration and defining a bottom wall adapted to rest on and be secured to the building foundation and opposing side walls extending upwardly from the bottom wall. The bottom wall of the track includes a plurality of pre-formed, linearly aligned bottom wall apertures at predetermined locations along the length thereof for receiving fasteners to secure the track to the foundation. Dimensionally stabile, pre-apertured vertical posts are secured to the track at predetermined locations along the length thereof via flanges extending perpendicularly upward from the bottom wall of the track. To facilitate the attachment of the posts to the track, each of the flanges include a plurality of pre-formed flange apertures which are precisely located so as to be in registry with pre-formed lower post apertures disposed in the bottom ends of the posts to receive fasteners such as self-tapping screws. Advantageously, the bottom ends of the posts include recesses disposed therein to receive the top portions of the fasteners used to secure the track to the foundation. By positioning the posts directly over the fasteners used to secure the track to the foundation, the track and post are in effect directly secured to the foundation thereby significantly enhancing the seismic stability of the resultant wall structure. In this respect, during seismic activity the weight of the building is resisted by the interaction of the foundation to the wall structure wherein the holding power at the lever arms of the posts is maximized.

In the preferred embodiment, the track is fabricated from either sheet metal or from an extruded, rigid polymer material. Where the track is fabricated from a rigid polymer, the bottom wall thereof may further include a plurality of longitudinally extending projections formed on the underside thereof for forming a moisture tight seal and thermal barrier against the foundation when the track is secured thereto. Where the track is fabricated from sheet metal, a layer of polymer sealing material may be placed between the bottom wall of the track and the foundation to facilitate a similar moisture tight, thermal barrier. Additionally, the opposing sidewalls of the track is preferably provided with pairs of V-shaped notches disposed along the upper edges thereof for placing a drilling jig in vertical registry with the bottom wall apertures to aid in the attachment of the track to the foundation.

Secured to the top ends of the posts is an elongate lower header beam preferably formed of plural beam segments. Attached to the top of the lower header is an elongate upper header beam or top plate having a width preferably exceeding the width of the lower header. In the preferred embodiment, the top ends of each of the posts are attached to the lower header via a pair of header brackets. Each of the header brackets includes a vertical flange portion having a pair of pre-formed vertical flange apertures disposed therein which are oriented so as to be in registry with pre-formed upper post apertures disposed in the top end of the post. The header brackets are interfaced to the top end of the post such that the vertical flange apertures of each header bracket of the pair and the upper post apertures are coaxially aligned. These coaxially aligned apertures are adapted to receive fasteners to secure the header brackets to the top end of the post. Each of the header brackets further includes a horizontal flange portion having a pair of pre-formed horizontal flange apertures disposed therein which are oriented so as to be in registry with pre-formed lower header apertures. The coaxially aligned horizontal flange apertures and lower header apertures are adapted to receive fasteners to secure the lower header to the pair of header brackets. The upper flange portions of the header brackets of the pair and the lower header further include apertures in registry with each other and with a pair of pre-formed upper header apertures to receive fasteners to secure the upper header to the lower header.

Disposed between each pair of adjacent posts is a pre-fabricated wall section. In the preferred embodiment, each of the wall sections in fabricated from polystyrene foam material and includes a vertical tongue formed along a first vertical edge, a vertical slot formed within a second vertical edge, a lower edge having a pair of parallel grooves formed therein for receiving the opposing sidewalls of the track, and an upper edge having a horizontal slot formed therein for receiving the lower header. Each of the wall sections is disposed between a pair of adjacent posts such that the vertical tongue abuts one of the posts of the post pair with the vertical slot receiving and encapsulating the other post of the post pair and the vertical tongue of an adjoining wall section. The vertical tongues and vertical slots of each of the wall sections further include one or more vertical grooves formed therein for receiving a foam adhesive to form an expanded foam seal between the vertical tongue and the one post of the post pair and the vertical slot and the other post of the post pair. Additionally, the horizontal slot and lower edge include horizontal grooves formed therein for receiving a foam adhesive to form an expanded foam seal between the horizontal slot and a lower header beam segment and the lower edge and track. Advantageously, the expanded foam adhesive seals interface the posts, track, beam segments and wall sections to each other in a manner forming a monolithic structure. In this respect, the interface between the posts, track, beam segments and wall sections produces a synergistic effect by utilizing the compressive, tensile and shear force properties of the posts, track, beam segments and the wall sections thus forming the monolithic wall structure.

The floor structure of the present invention preferably comprises a plurality of elongate floor joists which are attached to the foundation and extend in parallel relation. Each of the floor joists is preferably configured as an I-beam and comprises upper and lower elongate flanges having a strand board web extending perpendicularly therebetween. Disposed between each pair of adjacent joists is a pre-fabricated, polystyrene foam floor section. Each of the floor sections includes first and second horizontal edge portions which are disposed between and abutted against the webs of the floor joist pair. The first and second horizontal edge portions of each floor section further include a plurality of longitudinally extending channels formed therein for receiving a foam adhesive to form an expanded foam seal between the edge portions and the pair of joists.

The monolithic ceiling structure of the present invention preferably comprises a plurality of elongate ceiling trusts which are attached to the header beam and extend in parallel relation. Like the floor joists, each of the ceiling trusts preferably has a I-beam configuration and comprises upper and lower elongate flanges having a strand board web extending perpendicularly therebetween. Disposed between each pair of adjacent ceiling trusts is a pre-fabricated, polystyrene foam ceiling section which includes first and second angled edge portions. Each ceiling section is disposed between a pair of adjacent ceiling trusts in a manner wherein the angled edge portions thereof are abutted against and adhesively secured to the webs of each of the ceiling trusts of the ceiling trust pair.

The present invention further comprises a method of forming a monolithic wall structure from a prefabricated post and beam frame and interlocking foam wall sections. The method comprises the steps of securing an elongate track to a horizontal foundation and subsequently securing the bottom end of an elongate, vertical post to the track at a predetermined location thereon via a first pre-fabricated registration means. A pre-fabricated wall section is then disposed upon the track in a manner wherein the pair of parallel grooves formed within a lower edge thereof receive a portion of the track and a vertical tongue formed along a first vertical edge of the wall section abuts the post. A second post is then secured to the track in a manner wherein a vertical slot formed within a second vertical edge of the wall section receives and encapsulates the second post. The vertical slot further encapsulates the vertical tongue of a second adjoining wall section which is abutted against the second post. Thereafter, at least one elongate, horizontal header beam is received into aligned, horizontal slots formed in the upper edges of the wall sections and secured to the top ends of the posts via a second pre-fabricated registration means.

The preferred method of forming the monolithic wall structure further comprises the step of injecting a foam adhesive into vertical grooves formed in the vertical tongue and vertical slot of each wall section and the horizontal grooves formed in the horizontal slot and lower edge of each wall section to form an expanded foam seal between the vertical tongue and one post of the post pair, the vertical slot and the other post of the post pair, the horizontal slot and a lower beam segment and the lower edge and the track. As previously specified, in the preferred method a first vertical post is plumbed with all other posts being subsequently plumbed due to the dimensional stability of the first and second registration means of the track and header beam. Additionally, in the preferred method the wall structure is adapted to be assembled utilizing solely screw fasteners and the expansive adhesive.

The preferred method further comprises the step of enplacing of plumbing manifold and electrical system into one or more of the wall sections without cutting through the posts and/or header beam. The plumbing manifold and electrical system are preferably installed following assembly of the monolithic wall structure. As will be recognized, such installation may comprise the further step of using a foam chase in relation to particular plumbing applications.

After the monolithic wall structure has been fabricated, a layer of finishing material may be applied to the inner and/or outer surfaces thereof. The finishing material is typically selected from the group of drywall, plywood, and fiberboard and may be affixed to the inner or outer surfaces of the wall structure via the attachment to the header beam or via an adhesive. Additionally, a layer of netting material may be applied to the outer surfaces of the wall structure with a layer of stucco being subsequently applied to the layer of netting material. As previously specified, each of the posts is provided with a plurality of linearly aligned apertures disposed along the length thereof. Advantageously, these apertures may be used to interface pairs of window brackets to the posts for purposes of attaching a sill member and jam member between pairs of adjacent posts. As will be recognized, the sill and jam members are used for purposes of constructing windows or doors. In those instances when a window or door is constructed, the wall sections of the wall structure must be cut to accommodate the same.

The present invention further comprises methods of forming floor and ceiling structures. The formation of the floor structure comprises the steps of attaching an elongate floor joist to the foundation and subsequently abutting a first horizontal edge portion of a floor section thereagainst. A second floor joist is then attached to the foundation in a manner wherein the second joist is abutted against the second horizontal edge portion of the floor section. Thereafter, a foam adhesive is injected into the longitudinal channels formed in the first and second horizontal edge portions of each floor section to form an expanded foam seal between the horizontal edge portions and each floor joist of the floor joist pair. The method of fabricating the floor structure further comprises the step of applying a layer of finishing material such a plywood over the tops of the floor joists.

The method of forming the monolithic ceiling structure comprises the steps of attaching a ceiling trust to the header beam and subsequently adhesively securing a first angled edge portion of a ceiling section thereto. A second ceiling trust is then attached to the header beam in a manner wherein the second trust is abutted against and adhesively secured to the second angled edge portion of the ceiling section. Thereafter, a layer of sheathing is applied to the tops of the ceiling trusts with a layer of roofing material subsequently being applied to the sheathing.

BRIEF DESCRIPTION OF THE DRAWINGS

These as well as other features of the present invention will become more apparent upon reference to the drawings wherein:

FIGS. 12A, 12B, and 12C are perspective views illustrating the method of constructing the wall structure of the present invention;

FIG. 13 is a perspective view illustrating the manner in which plumbing and electrical conduits are formed in the wall sections of the wall structure;

FIG. 14 is a partial perspective view of a post of the wall structure illustrating the manner in which jam and sill members are engaged thereto for forming a window;

FIG. 15 is a partial perspective view of a wall section illustrating the manner in which an electrical system is emplaced into the wall section after conduits are formed therein in the manner shown in FIG. 13;

FIG. 16 is a cutaway perspective view illustrating the manner in which layers of finishing materials may be applied to the inner or outer wall surfaces of the wall structure;

DETAILED DESCRIPTION OF THE PREFERRED EMBODIMENT

Figure 1:
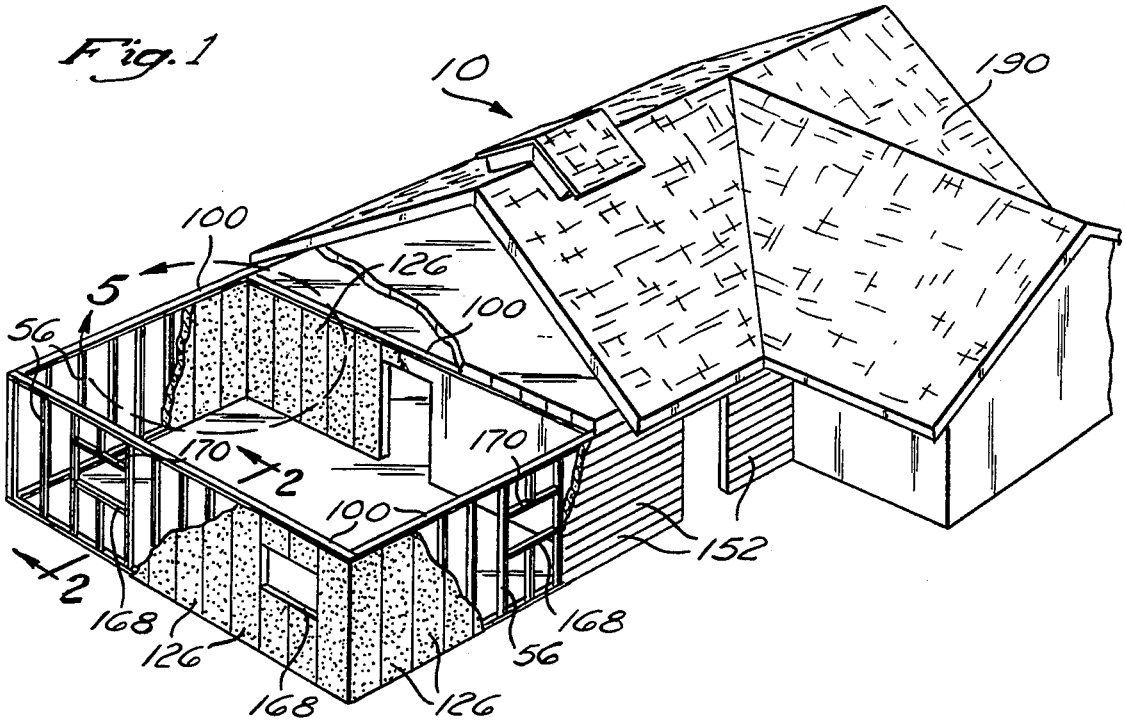
FIG. 1 is a perspective view of a residential dwelling constructed utilizing the building structures of the present invention.

Referring now to the drawings wherein the showings are for purposes of illustrating a preferred embodiment of the present invention only, and not for purposes of limiting the same, FIG. 1 illustrates a residential structure 10 constructed utilizing the improved wall, floor and ceiling building structures of the present invention. Although the present invention as will hereinafter be described has specific utility in residential structures, it will be recognized that the various building structures and methods of fabricating the same may additionally be utilized in conjunction with commercial building structures as well. Additionally, though the wall, floor and ceiling structures of the present invention will be described as being utilized to fabricate the residential structure 10 having the design depicted, it will be recognized that such components are of sufficient architectural flexibility so as to be usable in conjunction with residential or commercial structures having a wide variety of different design configurations.

The wall, floor and ceiling structures of the present invention are fabricated from dimensionally stable components which allow the structures, and hence the residential structure 10 to be assembled by unskilled labor with a minimal amount of difficulty. Additionally, each of the components utilized to fabricate the wall, floor and ceiling structures are pre-fabricated off-site using high tolerance mass production techniques. The present building structures and building technique are adapted to fabricate the residential structure 10 from the foundation to the roof by providing the necessary wall, floor and ceiling structural elements. In the following paragraphs, the wall, floor and ceiling structures of the present invention and methods of fabricating the same will be separately described.

FLOOR STRUCTURE

Referring now to FIGS. 1–5, the floor structure 12 comprises a plurality of floor joists 14 which are attached to a foundation structure 16 in a manner wherein the floor joists 14 extend in spaced, parallel relation. Each of the floor joists 14 preferably has an I-beam configuration and comprises an elongate upper flange 18 and an elongate lower flange 20 having a generally planer strand board web 22 extending perpendicularly therebetween. The upper flange 18, lower flange 20 and web 22 are preferably fabricated from gang laminated LVL (laminated veneer lumber) material though other materials may be utilized as an alternative. Advantageously, each of the floor joists 14 is given an I-beam configuration for strength as well as for greater vertical and lateral load resistance.

Figure 2:
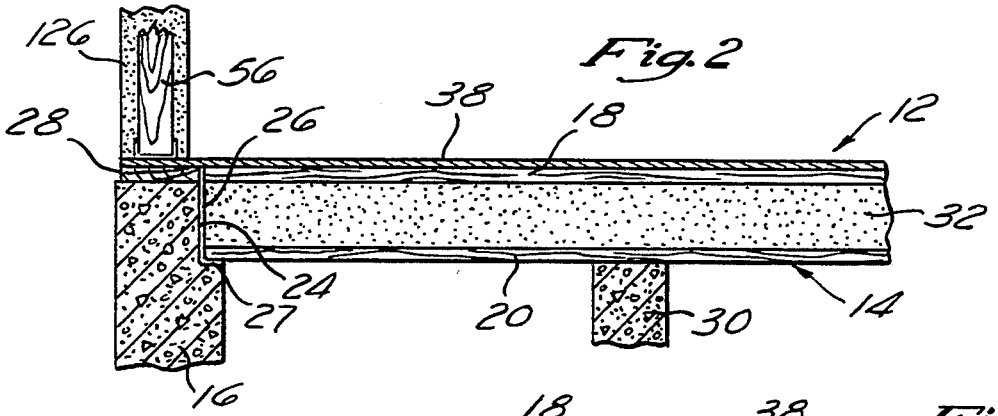
FIG. 2 is a cross-sectional view of the floor structure taken along line 2—2 of FIG. 1.

The foundation structure 16 to which the joists 14 are connected comprises a concrete foundation which is fabricated in accordance with conventional foundation construction techniques. To facilitate the attachment of the floor joists 14 to the foundation structure 16, a notch 16 is preferably formed in the inner, upper edge of the foundation structure having a generally rectangular configuration. Disposed within the notch 24 is a foundation bracket 26 having a configuration complementary to the notch 24. The foundation bracket 26 is sized such that when placed in the notch 24, the upper end thereof extends slightly beyond the top surface of the foundation structure 16 to a height substantially flush with the top surface of a mud sill 28 attached to the top surface of the foundation structure 16. Though not shown, the foundation bracket 26 is rigidly attached to the inner edge of the mud sill 28 via a sill bolt. The use of the mud sill 28, in addition to serving as a support structure for the foundation bracket 26, will be discussed in greater detail below. In attaching the floor joists 14 to the foundation structure 16, the floor joists 14 are secured to the foundation bracket 26 in a manner wherein one end of the lower flange 20 resides upon the lower, horizontal edge 27 of the foundation bracket 26, with the outermost ends of both the upper flange 18 and lower flange 20 being abutted against the vertical portion of the foundation bracket 26. As seen in FIG. 2, when the floor joists 14 are securely interfaced to the foundation bracket 26, the top surface of the upper flange 18 is substantially flush with both the top end of the foundation bracket 26 and top surface of the mud sill 28. Advantageously, the foundation bracket 26 allows the floor joists 14 and hence the floor structure 12 to be suspended within the interior of the building structure and foundation, thus providing increased seismic stability by preventing the floor structure 12 from rolling off the foundation during an earthquake. As also seen in FIG. 2, additional support may be provided to each of the floor joists 14 via one or more secondary concrete support walls 30 of the foundation of the residential structure 10.

Disposed between each pair of adjacent joists 14 is a pre-fabricated floor section 32. In the preferred embodiment, each of the floor sections 32 is fabricated from polystyrene foam and defines first and second horizontal edge portions. Each of the floor sections 32 is disposed between an adjacent pair of floor joists 14 in a manner wherein the first and second horizontal edge portions thereof are each received into a recess defined by portions of the top surface of the lower flange 20, bottom surface of the upper flange 18 and one planer face of the web 22 of one of the floor joists 14 of the pair.

Figure 3:
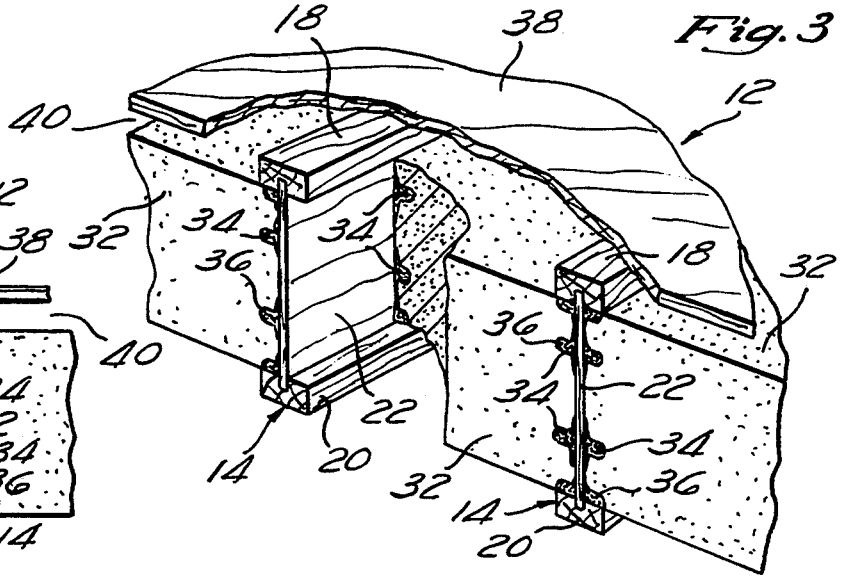
FIG. 3 is a cutaway fragmentary view of the floor structure of the present invention.
Figure 4:
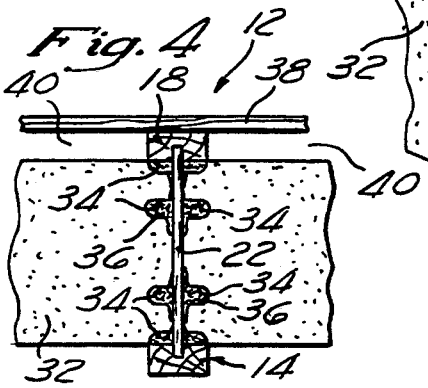
FIG. 4 is an elevational view of the floor structure of the present invention.
Figure 5:
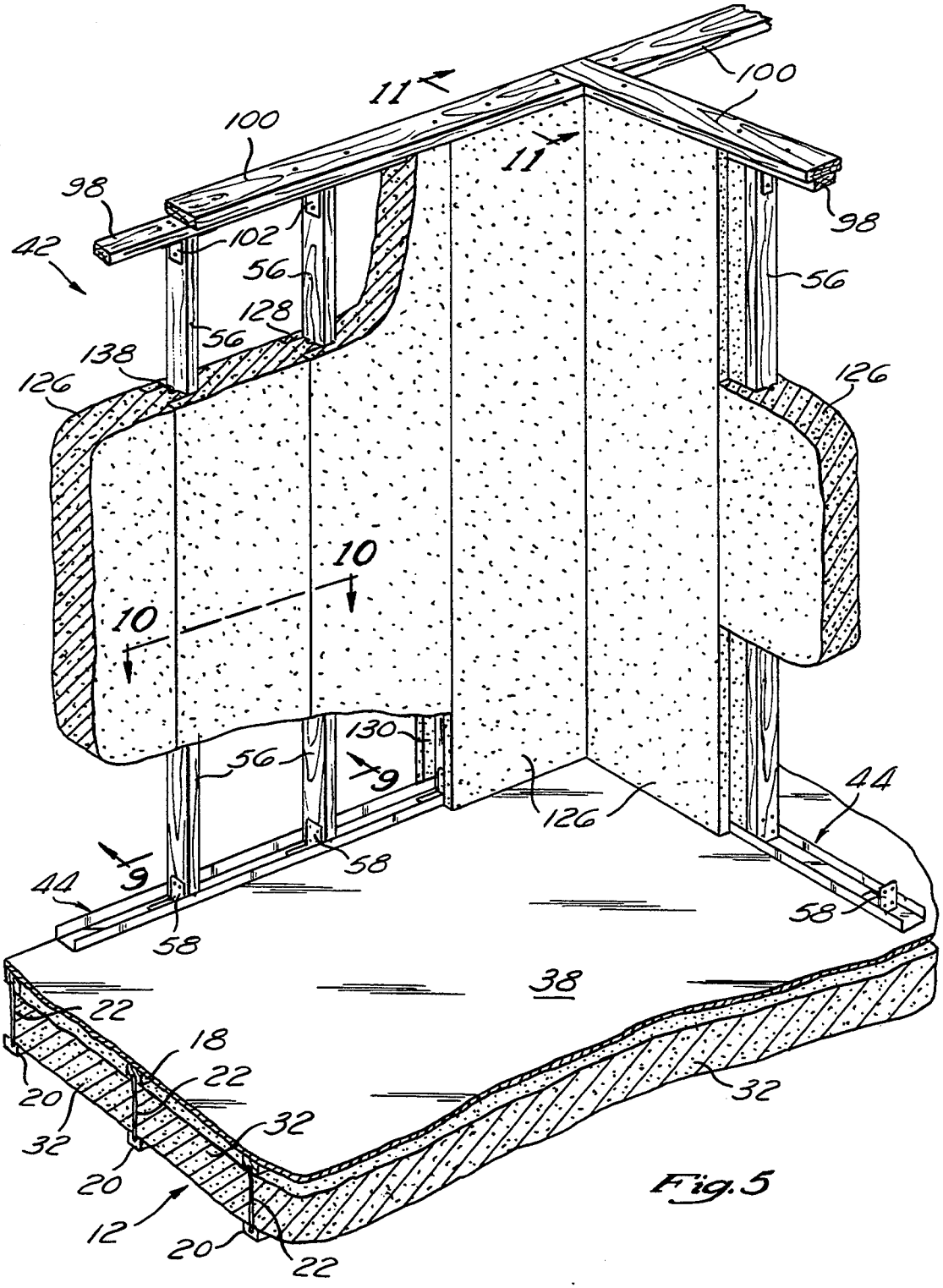
FIG. 5 is a cutaway fragmentary view illustrating the components comprising the floor and wall structures of the present invention.

As best seen in FIGS. 3 and 4, formed in the first and second horizontal edge portions of each of the floor sections 32 are a plurality of longitudinally extending channels 34. Preferably, each of the horizontal edge portions of the floor section 32 include four channels formed therein. When the horizontal edge portions of the floor section 32 are disposed between a pair of adjacent floor joists 14, one channel 34 is disposed adjacent the corner defined by the upper flange 18 and web 22, a second channel is disposed adjacent the corner defined by the lower flange 20 and web 22, with the remaining two channels 34 being disposed adjacent the central portion of the web 22. In the preferred embodiment, each of the channels 34 are adapted to receive a quantity of an adhesive such as a foam material for purposes of forming expanded foam seals 36 between the first and second horizontal edge portions of the floor section 32 and the floor joists 14 of the pair. Though the floor section 32 is preferably abutted against each of the floor joists 14 of the pair when inserted therebetween, the expanded foam seals 36 are operable to secure the floor sections to the floor joists and thereby increase the compressive strength of each foam floor section 32 so as to enhance the shear resistance of the floor structure 12. Additionally, the foam seals 36 aid in sealing against the infiltration of moisture, air or harmful radon gas into the residential structure 10 via the floor structure 12 as well as reduce heat transfer across the floor structure.

In assembling the floor structure 12, a first floor joist 14 is attached to the foundation structure 16 via the foundation bracket 26 in the manner previously described. Thereafter, one of the horizontal edge portions of a floor section 32 is inserted into the recess defined by the lower flange 20, upper flange 18 and strand board web 22 and is secured to the first floor joist 14 via the injection of foam adhesively into the channels 34 of the horizontal edge portion to create the foam seals 36. A second floor joist 14 is then attached to the foundation structure 16 such that a recess defined thereby captures the horizontal edge portion of the first floor section 32 not captured in the recess defined by the first floor joist 14. Thereafter, foam adhesive material is injected into the channels 34 of the second, captured horizontal edge portion to firmly secure the floor section 32 between the adjacent pair of floor joists 14. Retaining floor joists 14 and floor sections 32 are subsequently assembled in an analogous material throughout the structure.

After the assembly of the floor joists 14 and floor sections 32, a layer of finishing material such as a plywood sheet 38 is secured to the top surfaces of the upper flanges 18. As best seen in FIG. 4, when the plywood sheet 38 is attached to the upper flanges 18 of the floor joists 14, a space 40 is defined between the plywood sheet 38 and the top surfaces of the floor sections 32. Advantageously, the space 40 provides dead-space insulation which, in conjunction with the polystyrene floor sections 32 and foam seals 36, greatly enhances the overall thermal efficiency of the floor structure 12. Additionally, the space 40 serves as electrical/plumbing service conduit as will be described in more detail below.

Though the floor structure 12 has been described for use in conjunction with a plywood sheet 38 serving as the layer of finishing material, it will be recognized that the design of the floor structure 12 may be modified to accommodate a concrete slab floor as would be used in a commercial building structure. Advantageously, the floor structure 12 of the present invention is designed so as to possess significant seismic stability when seismic forces are applied to the residential structure 10. Additionally, since the floor structure 12 does not incorporate cement or any other hydrophilic material, continual watering as would occur from automatic sprinklers around the base of the residential structure 10 is not easily absorbed into the floor structure 12 and thus not transported to the wood components thereof. As such, problems associated with mildew, dry rot, fungus and ground settling which are typically encountered with conventional floor structures are eliminated by the design and materials used in conjunction with the floor structure 12. As such, the floor structure 12 is particularly adapted to be less susceptible to risk of damage when seismic forces are applied thereto.

WALL STRUCTURE

Figures 6, 7:
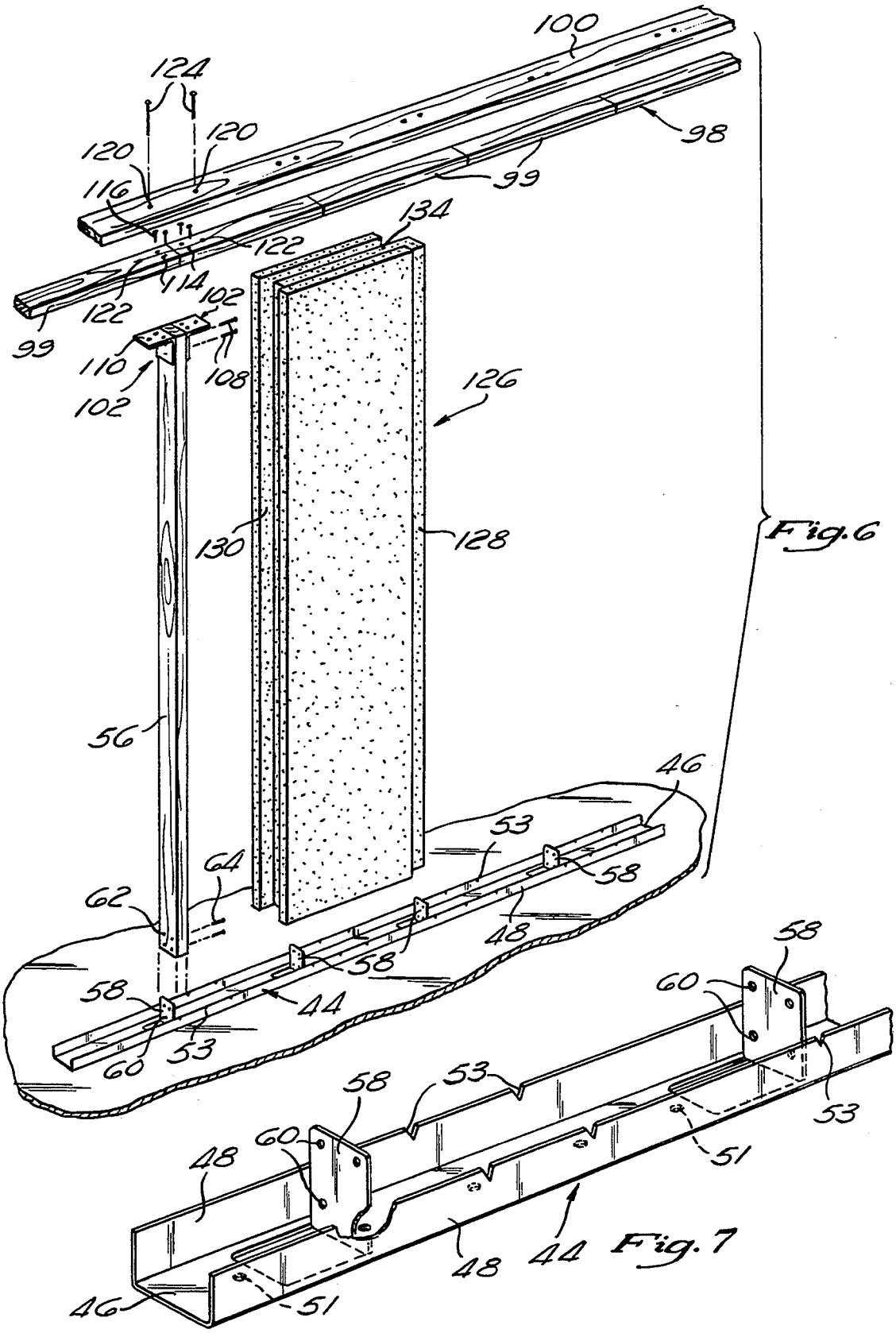
FIG. 6 is an exploded view of the components comprising the wall structure of the present invention.
FIG. 7 is a partial perspective view of the track used in constructing the wall structure.
Figure 8:
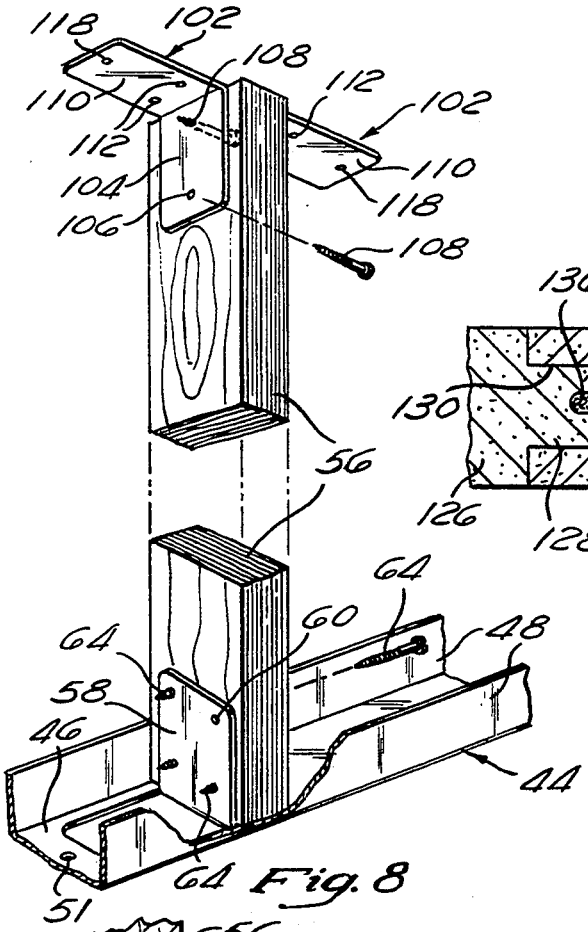
FIG. 8 is a partial perspective view illustrating the manner in which the posts of the wall structure are secured to the track and header brackets of the wall structure.
Figure 9A:
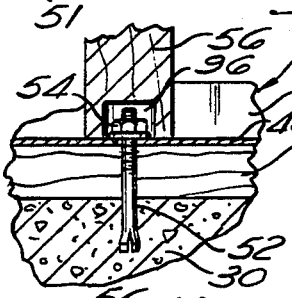
FIG. 9A is a cross-sectional view illustrating the engagement of the wall structure to the foundation.
Figure 9:
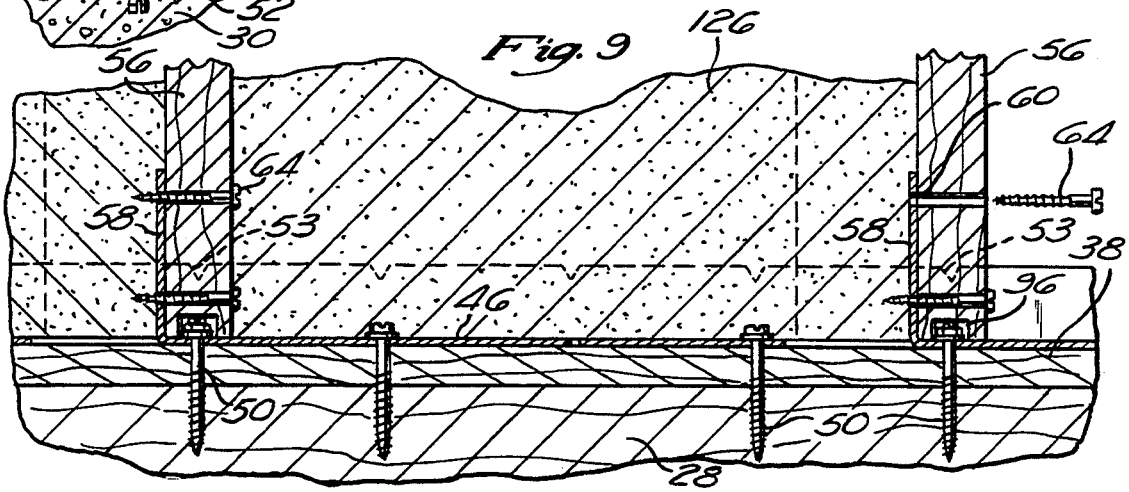
FIG. 9 is a cross-sectional view taken along line 9—9 of FIG. 5.

Referring now to FIGS. 5–11, the present invention further comprises a dimensionally stable, monolithic wall structure 42 which, like the floor structure 12, is specifically adapted to resist shear and to be seismically stable. As seen in FIG. 6, the wall structure 42 is formed generally of an elongate track 44, plural posts 56, a lower header 98, upper header or top plate 100, and plural wall sections 126 which are assembled upon the floor. The posts 56, and headers 98, 100 are preferably fabricated from dimensionally stabile LVL material or tubular metal and are pre-fabricated off-site. The track 44 is preferably formed having a generally U-shaped configuration defining a bottom wall 46 and opposing side walls 48 which extend upwardly from the bottom wall 46. As seen in FIG. 9, the track 44, and more particularly the bottom wall 46 thereof, is adapted to rest on the plywood sheet 38 or other finishing material of the floor structure 12 and is secured to the underlying mud sill 28 via a plurality of fasteners 50 such as self-tapping screws. The fasteners 50 extend through the bottom wall 46 via a plurality of pre-formed, linearly aligned bottom wall apertures 51 disposed therein at predetermined locations along the length of the track 44. Disposed within the upper edges of the opposing sidewalls 48 of the track 44 are pairs of V-shaped notches 53 which are used for placing a drilling jig or similar structure in vertical registry with a respective bottom wall aperture 51. As will be recognized, in those instances where the wall structure 42 is not constructed about the outer periphery of the residential structure 10, the fasteners 50 may extend through the plywood sheet 38 into a support structure other than the mud sill 28, such as the upper flange 18 of a floor joist 14. Further, as seen in FIG. 9A, the track 44 may also be anchored directly to a portion of the foundation of the residential structure 10 such as the concrete support wall 30 via an anchor bolt 52 which extends from the support wall 30, through the plywood sheet 38 and track 44, with the track 44 being secured to the bolt 52 via a nut 54.

The wall structure 42 further comprises a plurality of elongate, vertical posts 56 of predetermined lengths, the bottom ends of which are secured at predetermined locations along the length of the track 44. In the preferred embodiment, the bottom ends of the posts 56 are secured to the track 44 via a plurality of flanges 58 which extend perpendicularly upward from the bottom wall 46 of the track 44. Each of the flanges 58 preferably include four pre-formed apertures 60 disposed therein in a generally square configuration which are oriented so as to be in registry with pre-formed lower post apertures 62 disposed in the bottom ends of the posts 56. As seen in FIG. 9, the posts 56 are secured to the flanges 58 by abutting the bottom ends thereof against the flanges 58 in manner wherein the apertures 60 and 62 are coaxially aligned. Thereafter, fasteners 64 such as self-tapping screws are inserted into the lower post apertures 62 and through the posts 56 so as to engage the flanges 58 via the apertures 60, thus securing the posts 56 to the flanges 58. Though as shown in FIG. 8, four fasteners 64 are utilized to secure each of the posts 56 to a respective flange 58, it will be recognized that greater or lesser numbers of fasteners 64 may be utilized.

Figure 20:
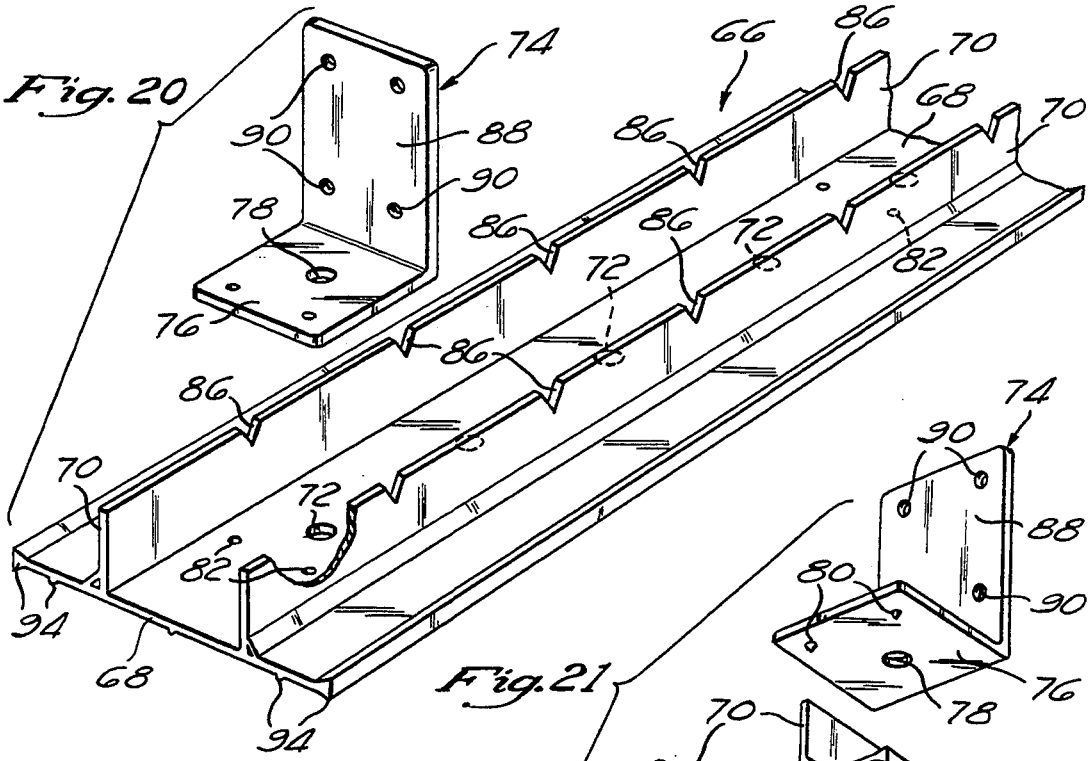
FIGS. 20 and 21 are perspective views illustrating a track constructed in accordance with a second embodiment of the present invention.
Figure 21:
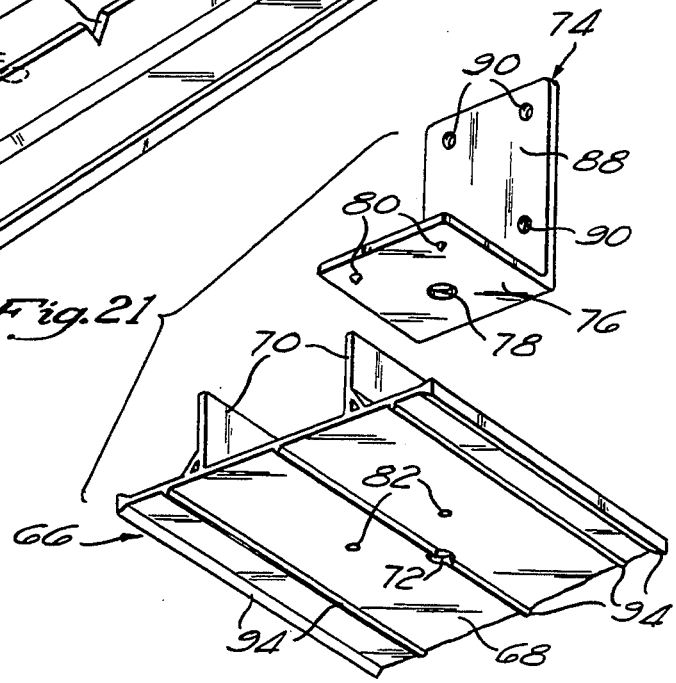
Figure 22:
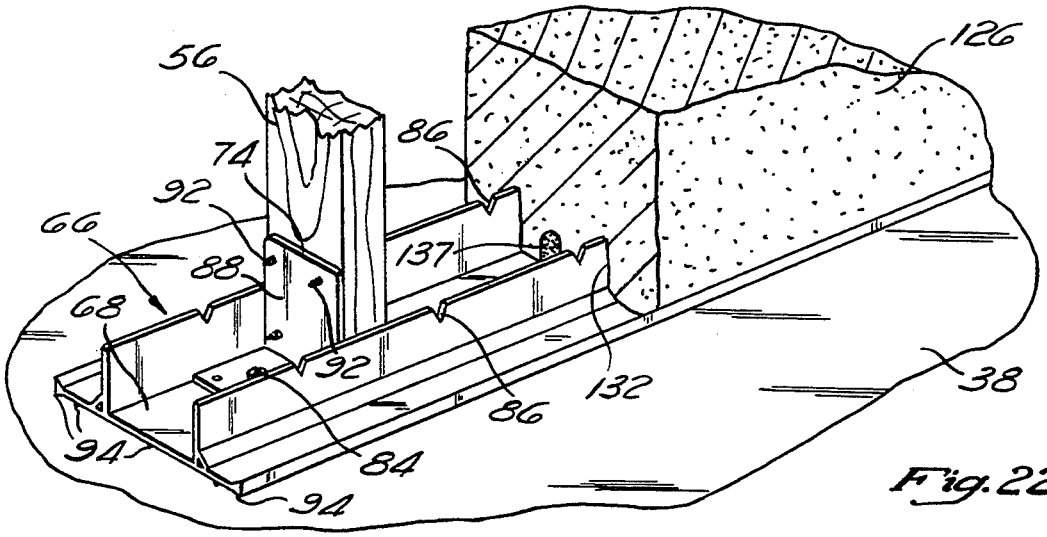
FIG. 22 is a partial perspective view illustrating the manner in which a wall section of wall structure is engaged to the track illustrated in FIGS. 20 and 21.

Referring now to FIGS. 20–22, disclosed is a track 66 constructed in accordance with a second embodiment of the present invention. Track 66, like track 44, also has a generally U-shaped configuration and defines a bottom wall 68 having opposing sidewalls 70 extending perpendicularly upward therefrom. To facilitate the attachment of the track 66 to the support structure underlying the plywood sheet 38, disposed in the bottom wall 68 are a plurality of pre-formed, linearly aligned bottom wall apertures 72. As an alternative to the flanges 58 included with the track 44, the bottom ends of the posts 56 are secured to the track 66 via a plurality of track brackets 74 which are attachable to the bottom wall 68 of the track 66. Each of the track brackets 74 has a generally L-shaped configuration and defines a lower flange portion 76 having a pre-formed lower aperture 78 extending therethrough, and a pair of registry tabs 80 formed on the bottom surface thereof. In the preferred embodiment, the registry tabs 80 are adapted to be receivable into a pair of locator apertures 82 disposed adjacent each of the bottom wall apertures 72. When the registry tabs 80 are received into a respective pair of locator apertures 82, the lower aperture 78 disposed in the lower flange portion 76 is coaxially aligned with the respective bottom wall aperture 72. Thereafter, both the track bracket 74 and track 66 are simultaneously secured to the underlying support structure via fasteners 84 such a self-tapping screws which are received through the coaxially aligned lower aperture 78 and bottom wall aperture 72. Similar to the track 44, the track 66 includes pairs of V-shaped notches 86 disposed along the top edges of the opposing sidewalls 70 for placing a drilling jig in vertical registry with the coaxially aligned lower aperture 78 and bottom wall aperture 72.

To facilitate their attachment to the bottom ends of the posts 56, each of the track brackets 74 further includes an upper flange portion 88 which extends perpendicularly upward from the bottom wall 68 when the lower flange portion 76 is secured thereto. The upper flange portion 88 includes four pre-formed upper flange apertures 90 disposed therein in a generally square configuration. The upper flange apertures 90 are oriented so as to be in registry with the pre-formed lower post apertures 62 disposed in the bottom ends of the posts 56. In this respect, the posts 56 are secured to the track brackets 74 by abutting the bottom ends thereof against the upper flange portions 88. Thereafter, fasteners 92 such as self-tapping screws are inserted into the lower post apertures 62 and through the posts 56 so as to engage the upper flange portions 88 of the track brackets 74 via the upper flange apertures 90.

In the second embodiment, the track 66 is a moisture track which is fabricated from an extruded polymer. Formed on the bottom surface of the bottom wall 68 and on each of the opposed edges of the bottom wall 68 are longitudinally extending projections 94 which are utilized to form a moisture-tight seal and thermal barrier against the plywood sheet 38 or other layer of finishing material when the track 66 is rigidly secured to the underlying support structure. Though the track 44 which is preferably fabricated from sheet metal is not provided with such projections, it will be recognized that prior to securing the track 44 to the underlying support structure, a separate polymer plate or similar structure may be inserted between the bottom wall 46 and top surface of the plywood sheet 38 so as to form a moisture-tight, thermal barrier as do the projections 94 of the extruded polymer track 66. Advantageously, the moisture and thermal barrier facilitated by the projections 94, or polymer plate used in conjunction with the track 44, is not violated over a prolonged duration of time. Though the track 66 is fabricated from a polymer, the track brackets 74 attached thereto are preferably fabricated from metal, though other materials may be utilized as an alternative.

As seen in FIGS. 9 and 9A, in the preferred embodiment, the top ends of selected ones of the fasteners 50, 52 which are utilized to secure the track 44 to the mud sill 28, support wall 30, floor joist 14 or other underlying support structure are disposed directly under the posts 56. In the preferred embodiment, each of the posts 56 of the wall structure 42 includes a fastener 50, 52 directly underneath the bottom end thereof. To accommodate the top ends of the fasteners 50, 52 the bottom end of each post 56 is provided with a recess or counterbore 96. Advantageously, by placing the fasteners 50, 52 into the underlying support structure directly under the posts 56, the seismic stability of the wall structure 42 is significantly increased. In this respect, during seismic activity the weight of the residential structure 10 is resisted by the interaction of the foundation and the wall structure 42 since the holding power is maximized at the lever arms of the posts 56. Though each-of the posts 56 preferably includes a fastener 50,52 located underneath the bottom end thereof, the fasteners may only be included under selected ones of the posts 56.

Figure 11:
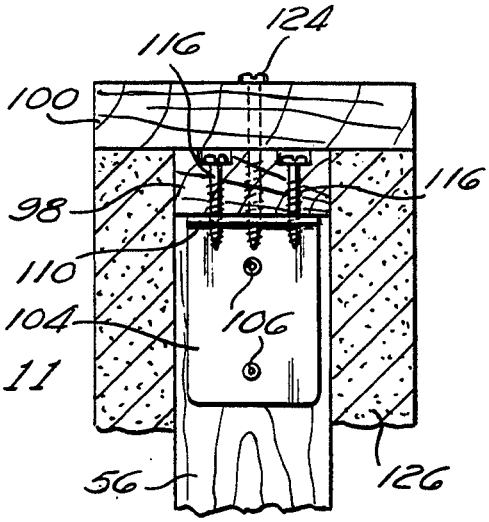
FIG. 11 is a cross-sectional view taken along line 11—11 of FIG. 5.

Referring now to FIGS. 6, 8, and 11, in constructing the wall structure 42, attached to the top ends of the posts 56 is a lower header beam 98 and an upper header beam or top plate 100. In the preferred embodiment, the lower header beam 98 is formed in segments 99 extending in abutted end-to-end orientation, each spanning between and being secured to the top ends of adjacent posts 56 via a pair of header brackets 102. Each of the header brackets 102 has a generally L-shaped configuration and includes a vertical flange portion 104 having a pair of pre-formed, linearly aligned vertical flange apertures 106 disposed therein. The vertical flange apertures 106 are oriented so as to be in registry with a pair of pre-formed upper post apertures disposed in the top end of each post 56. Two header brackets 102 are attached to the top end of each post 56 by abutting the vertical flange portions 104 of each bracket 102 against the top end such that the vertical flange apertures 106 disposed in each of the vertical flange portions 104 are coaxially aligned with the upper post apertures of the post 56. Thereafter, a pair of fasteners 108 such as self-tapping screws are inserted into the vertical flange apertures 106 of one of the header brackets 102 and inserted through the upper post apertures so as to engage the other header bracket 102 via the vertical flange apertures 106 thereof.

To facilitate the attachment of a segment 99 of the lower header beam 98 to a pair of header brackets 102 on adjacent posts 56, each of the header brackets 102 of the header bracket pair further includes a horizontal flange portion 110. Disposed in each horizontal flange portion 110 is a pair of horizontal flange apertures 112 which are oriented so as to be in registry with a corresponding pair of pre-formed lower header apertures 114 disposed within the segment 99. When the pair of header brackets 102 are secured to a respective pair of posts 56, the horizontal flange portions 110 thereof and the uppermost ends of the posts 56 define a pair of planer surfaces against which the bottom surface of the segment 99 is rested. When the segment 99 is abutted against the horizontal flange portions 110 of the header brackets 102, fasteners 116 such as self-tapping screws are inserted into both pairs of the lower header apertures 114 of the segment 99 and through the segment 99 so as to engage the header brackets 102 via both pairs of horizontal flange apertures 112 thus securing the segment 99 to the header brackets 102.

After the segments 99 have been secured to the top ends of the posts 56 via the header brackets 102 thus forming the lower header beam 98, the upper header beam or top plate 100 is disposed upon the top surface of the lower header beam 98 and likewise secured to the horizontal flange portions 110 of the header brackets 102. In this respect, the horizontal flange portion 110 of each header bracket 102, in addition to including the pair of horizontal flange apertures 112, further includes an aperture 118. When the brackets 102 are attached to the posts 56, the apertures 118 of the horizontal flange portions 110 are oriented so as to be in registry with preformed upper header apertures 120 disposed in the upper header beam 100. Each segment 99, in addition to including the pairs of lower header apertures 114, also includes apertures 122 which are in registry with the apertures 118 of the pair of header brackets 102 when the segment 99 is attached thereto. In attaching the upper header beam 100 to the header brackets 102, inserted into the upper header apertures 120 are fasteners 124 such as self-tapping screws which extend through the upper header beam 100 and the apertures 122 of the segments 99 of the lower header beam 98 so as to engage the horizontal flange portions 110 of the header brackets 102 via the apertures 118. As best seen in FIG. 11, the top ends of the lower header apertures 114 are preferably counter-sunk so that the head portions of the fasteners 116 do not interfere with the upper header beam 100 when such is attached to the lower header beam 98. In the preferred embodiment, the header brackets 102 are fabricated from metal, though other materials may be utilized as an alternative.

Disposed between each pair of adjacent posts 56 is a pre-fabricated wall sections 126. In the preferred embodiment, each of the wall sections 126 is pre-fabricated off-site from nominal 6 inch thick polystyrene foam and has a generally rectangular configuration defining a vertical tongue 128 formed along first vertical edge and a vertical slot 130 formed within a second vertical edge. As best seen in FIGS. 6 and 22, each of the wall sections 126 further includes a lower edge having a pair of parallel grooves 132 formed therein for receiving the opposing sidewalls 48, 70 of the tracks 44, 66 as will be explained below. Each wall section 126 further includes an upper edge having a horizontal slot 134 formed therein for receiving the lower header beam 98. In the preferred embodiment, each wall section 126 is disposed between a pair of adjacent posts 56 such that the vertical tongue 128 abuts one the posts 56 of the post pair and the vertical slot 130 receives and encapsulates the other post 56 of the post pair and the vertical tongue 128 of an adjoining wall section 126.

Figure 10:
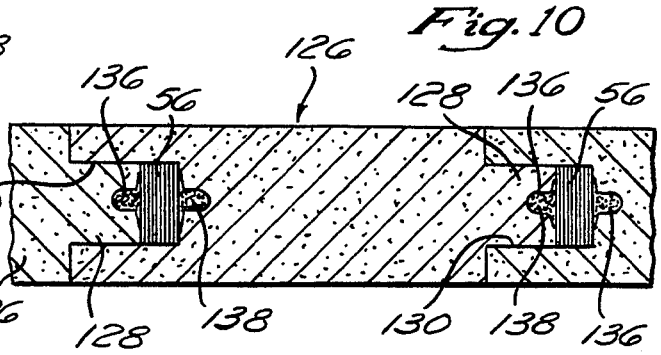
FIG. 10 is a cross-sectional view taken along line 10—10 of FIG. 5.

As best seen in FIG. 10, formed within the vertical tongue 128 and vertical slot 130 of each wall section 126 is a vertical groove 136. Additionally, formed within the lower edge and horizontal slot 134 of each wall section 126 is a horizontal groove 137. When a wall section 126 is disposed between an adjacent pair of posts 56 and interfaced to an adjoining wall section 126 in the aforementioned manner, a liquid foam adhesive is injected into the vertical grooves 136 to form expanded foam seals 138 between the wall section 126 and each of the posts 56 of the post pair. The liquid foam adhesive is also injected into the horizontal grooves 137 to form expanded foam seals 139 between the wall section 126 and the track 44, 66 and lower header beam 98 as will be explained below. Advantageously, the creation of the foam seals 138, 139 transforms the wall structure 42 into a monolithic structure and adds to the overall strength of the wall structure 42 by enhancing the fundamental shear strength thereof.

To assemble the wall structure 42, the entire track 44, is initially laid down upon the floor for the entire wall structure 42 of the residential structure 10 to ensure proper location. Thereafter, the V-shaped notches 53, 86 are utilized to register the fasteners 50, 52 within a respective bottom wall aperture 51, 72. In the preferred embodiment, the V-shaped notches 53, 86 are disposed at seven inch centers or at seven inch multiples, i.e. center-to-center distances of fourteen inches, twenty eight inches, etc. As such, the track 44, 66 allows for the exact and precise positioning and tying in of the track 44, 66 and hence the wall structure 42 to the foundation of the residential structure 10.

Referring now to FIGS. 12A, 12B, and 12C, after the track 44, 66 is secured to the underlying support structure in the desired configuration for the residential structure 10, the bottom end of a first post 56 is secured to the track 44, 66 via a flange 58 or track bracket 74 in the aforementioned manner. After a first post 56 has been secured to the track 44, 66, a first wall section 126 is lowered upon the track 44, 66 such that the opposing sidewalls 48, 70 of the track 44, 66 are received into the parallel grooves 132 formed in the lower edge of the wall section 126. Importantly, the wall section 126 is oriented such that the vertical slot 132 faces the first attached post 56. Thereafter, the wall section 126 is slid toward the first post 56 such that the post 56 is received into the vertical slot 130 and firmly abutted against the innermost surface 140 thereof. When the post 56 is received into the vertical slot, the horizontal flange portion 110 of one of header brackets 102 of the pair already secured to the top end of the first post 56 will be received into the horizontal slot 134 and abutted against the lowermost surface 142 thereof.

After the first post 56 has been received into the vertical slot 130, a second post 56 is secured to the track 44, 66 in a manner wherein the second post 56 is firmly abutted against the outermost surface of the vertical tongue 128. Advantageously, the flange 58 or track bracket 74 to which the bottom end of the second post 56 is secured is specifically oriented such that the second post 56 will abut the vertical tongue 128 in the aforementioned manner when secured thereto. After the second post 56 is secured to the track 44, 66, the wall section 126 will be firmly disposed, i.e. compressed between the pair of adjacent posts 56. Thereafter, liquid foam is injected into the vertical grooves 136 to form the foam seals 138 between the wall section 126 and pair of posts 56. The liquid foam is also injected into the horizontal groove 137 in the lower edge to form the foam seal 139 between the wall section 126 and the track 44, 66. A second wall section 126 is then placed upon the track 44, 66 in the same manner previously described and oriented such that the vertical slot 130 thereof faces the vertical tongue 128 of the first installed wall section 126 and second installed post 56. The second wall section 126 in then slid toward the first wall section 126 to a position whereat both the second post 56 and vertical tongue 128 of the first wall section 126 are received into the vertical slot 130 thereof. Thereafter, a third post 56 is affixed to the track 44, 66 so as to abut the vertical tongue 128 of the second installed wall section 126 in the same manner previously described. Liquid foam adhesive is then injected into the vertical grooves 136 of the second wall section 126 and horizontal groove 137 in the lower edge to form the foam seals 138, 139 between the second wall section 126 and those posts 56 between which it is oriented and the second wall section 126 and the track 44, 66. As will be recognized, third and subsequent wall sections 126 used to the form the wall structure 42 are added in the same manner previously described.

After a wall section 126 has been oriented between a pair of posts 56, a segment 99 of the lower header beam 98 is disposed into the horizontal slot 134 of the wall section 126 and secured to the horizontal flange portions 110 of a pair of the header brackets 102 in the manner previously described. The liquid foam is then injected into the horizontal groove 137 of the horizontal slot 134 to form the foam seal 139 between the horizontal slot 134 and the segment 99. After the desired number of wall sections 126 have been assembled in the wall structure 42 and the lower header beam 98 formed by the receipt of the segments 99 into the horizontal slots 134 in the aforementioned manner, the upper header 100 is placed upon the lower header 98 and likewise secured to the horizontal flange portions 110 of the header brackets 102 in the aforementioned manner. As best seen in FIG. 11, the width of the upper header beam is substantially identical to the overall width of the wall sections 126.

As will be recognized from the aforementioned construction process, when the wall structure 42 is erected, the foam wall sections 126 are entrapped, i.e. encapsulated, by the posts 56, lower header beam 98 and upper header beam 100, thus becoming an integral part of the wall structure 42. Advantageously, the wall sections 42 and upper header beam 100 provide uniform surfaces to which may be applied final wall finishes. Importantly, the extension of the foam wall sections 126 outward from both sides of the post 56 and the interlock of the wall sections 126 facilitated by the overlap of the vertical tongues 128 and vertical slots 130, provides the foam wall sections 126 with compressive strength to resist shear, which is increased by the expanded foam seals 138, 139. In this respect, by entrapping the foam wall sections 126 between the track 44, 66, posts 56 and upper and lower header beams 98, 100, the shear strength capability of the foam wall sections 126 are maximized due to the physical interaction of the components. Additionally, the aforementioned manner of construction eliminates slop and prevents moisture deterioration.

Figure 17:
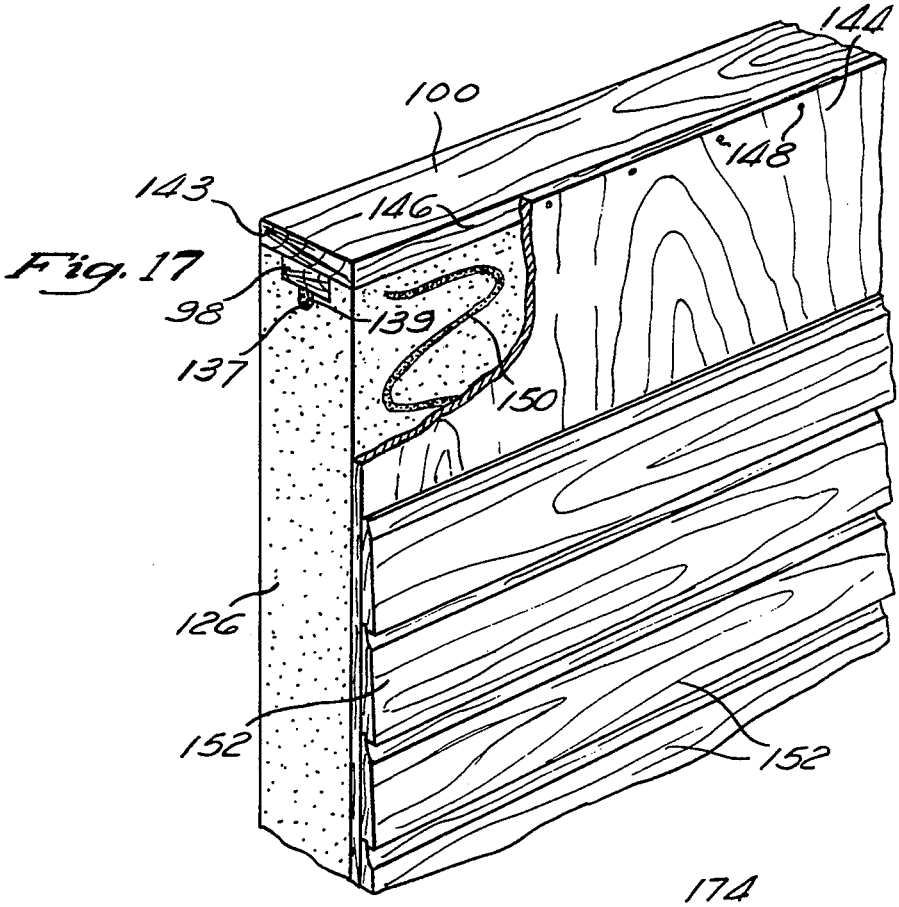
FIG. 17 is a cutaway perspective view illustrating the manner in which layers of finishing materials may be applied to the outer wall surfaces of the wall structure.

As previously specified, the wall sections 126 and upper header beam 100 provide uniform surfaces to which may be applied final wall finishes. In this respect, dry wall may be applied to the interior wall surfaces of the wall sections 126 by securing the top edge thereof to the inner edge 143 of the upper header beam 100 or by applying the drywall to the inner wall surfaces of the wall sections 126 via an adhesive. Additionally, as seen in FIG. 17, a wall finish such as a sheet of plywood 144 may be applied to the outer wall surfaces of the wall sections 126 by securing the upper edge thereof to the outer edge 146 of the upper header beam 100 via fasteners such as nails 148 and/or by utilizing an adhesive 150 applied to the outer wall surfaces of the wall sections 126. After the plywood sheet 144 has been secured to the outer wall surfaces of the wall sections 126, materials such as aluminum or wood siding 152 may be applied to the plywood sheet 144. As an alternative to the plywood sheet 144, other materials such as steel, vinyl, etc. may be applied to the inner and/or outer wall surfaces of the wall sections 126. Additionally, as seen in FIG. 16, a layer of netting 154 may be applied to the inner and/or outer wall surfaces of the wall sections 126 via securing the same to the upper header beam 100 or utilizing an adhesive, the netting 154 serving as a support material for a polymer-based marble filled, stucco-appearing coating 156 for ornamental finishes. Importantly, irrespective of the particular finishing material applied to the inner and/or outer wall surfaces of the wall sections 126, the foam core of the wall structure 42 facilitated by the wall sections 126 maximizes the thermal, acoustical and insulation qualities of the wall structure 42 and provides the necessary moisture barrier, resulting in a rigid, flat, smooth, square and plumb structure.

Referring now to FIGS. 13 and 15, subsequent to the securing of the wall sections 126 between the posts 56 and upper and lower header beams 98, 100, one or more of the wall sections 126 may be provided with conduits 158 for implacing a plumbing manifold or electrical system into the wall sections 126. Typically, the conduits 158 are formed via the utilization of a tool such as a hot knife 160, though other forming methods may be utilized. Through the use of the hot knife 160, other recesses may be formed within the wall sections 126 to accommodate components such as electrical outlet boxes 162. Advantageously, the one and one-half inch foam overlay of the wall sections 126 facilitated by the vertical slots 130 allows for the emplacement of the plumbing and electrical systems into the wall sections 126 only and eliminates the need to cut through the posts 56 and/or upper and lower header beams 98, 100. In relation to particular plumbing applications, a foam chase may be utilized. Additionally, as seen in FIG. 15, after the plumbing or electrical system components have been inserted into the conduits 158, taping materials 164 may be utilized to cover the conduits 158 so as to provide uniform inner or outer wall surfaces for the wall sections 126 so that finishing materials may be applied thereto.

Referring now to FIG. 14, each post 56 is provided with a plurality of pre-formed, linearly aligned apertures 166 which are disposed along substantially the entire length of the post 56. In the preferred embodiment, the apertures 166 in each of the posts 56 are used for purposes of forming windows and doors between pairs of posts 56. Particularly, windows are formed via the utilization of a sill member 168 and a jam member 170, each of which are interfaced to the posts 56 via pairs of window brackets 172. The window brackets 172 each have a generally L-shaped configuration and are secured to either the sill member 168 or jam member 170 via the receipt of fasteners into a pair of apertures disposed in one of the two planar portions thereof. Thereafter, the sill member 168 and jam member 170, each having a pair of window brackets 172 attached thereto, are horizontally oriented between and secured to a pair of posts 56. The attachment to the posts 56 is facilitated by the receipt of fasteners into pairs of apertures disposed in the other planar portion of each of the window brackets 172 into corresponding, coaxially aligned pairs of apertures 166 disposed within the posts 56. Advantageously, due to the placement of the apertures 166 within the posts 56, the window may be constructed having a multitude of different heights. Additionally, by cutting out central portions of one or more interior posts 56, the windows may be constructed having any of a number of desired widths. As will be recognized, when a window is formed within the wall structure 42, one or more wall sections 126 must be cut so as to accommodate the window. As previously specified methods similar to those previously discussed may be utilized to form doors within the wall structure 42.

ROOF STRUCTURE

Figure 19:
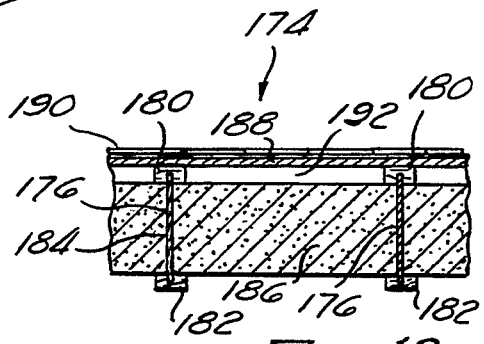
FIG. 19 is a cross-sectional view of the ceiling structure taken along line 19—19 of FIG. 18.
Figure 18:
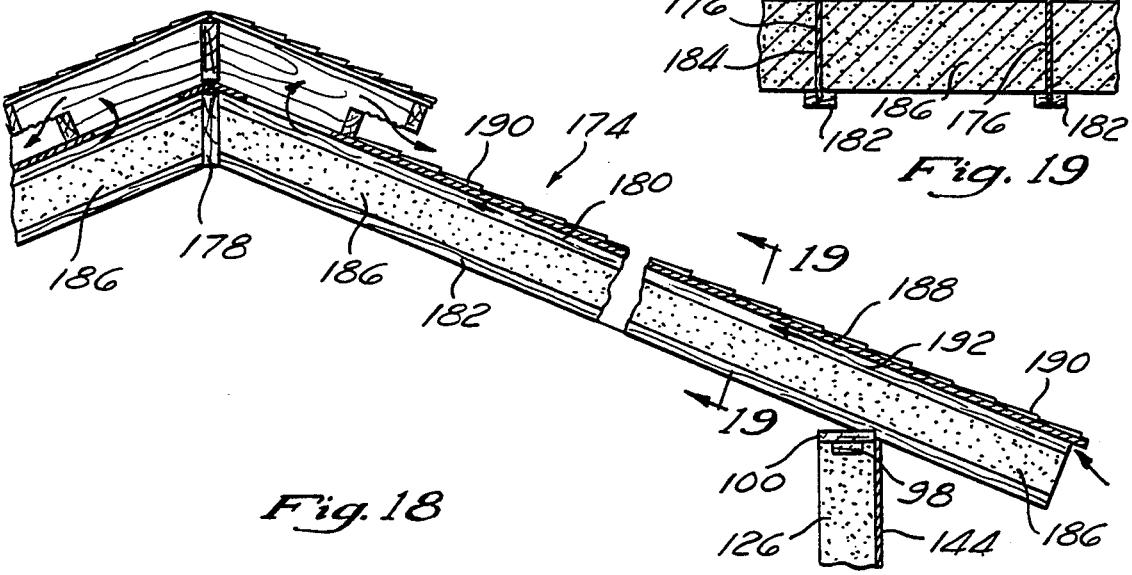
FIG. 18 is a cross-sectional view illustrating the ceiling structure of the present invention.

Referring now to FIGS. 18 and 19, the building system of the present invention further comprises a roof structure 174 formed in substantially the same manner as the floor structure 12. In the preferred embodiment, the roof structure 174 comprises a plurality of ceiling trusts 176 which are attached between the upper header beam 100 and a central support beam 178 in spaced, parallel relation. In the preferred embodiment, each of the ceiling trusts 176 has an I-beam configuration and includes an upper flange 180 and a lower flange 182 having a strand board web 184 extending perpendicularly therebetween. Like the floor joists 14, the ceiling trusts 176 are fabricated from gang laminated LVL (laminated veneer lumber) and are provided with an I-beam configuration for strength and for greater vertical and lateral load resistance.

Disposed between each pair of adjacent ceiling trusts 176 is a pre-fabricated ceiling section 186, which like the floor sections 32 and wall sections 126 is fabricated from polystyrene foam. Each of the ceiling sections 186 further includes first and second angled edge portions which are abutted against the ceiling trusts 176 of the ceiling trust pair when disposed therebetween. In the preferred embodiment, the first and second angled edge portions of each ceiling section 186 are glued in the recesses of the ceiling trusts 176 of the pair which are defined by portions of the lower surface of the upper flange 180, upper surface of the lower flange 182 and web 184. Thus, each of the ceiling sections 186 is rigidly maintained in position between the adjacent pair of ceiling trusts 176. In the preferred embodiment, the ceiling sections 186 are fabricated from six inch thick foam. When inserted between the pair of ceiling trusts 176, the upper plane of the ceiling section 186 is flush with the bottom surface of the upper flange 180 while the lower plane is flush with the top surface of the lower flange 182.

In the preferred embodiment, the roof structure 174 is constructed in a manner substantially identical to the manner by which the floor structure 12 is constructed. Initially, a first ceiling trust 176 is attached to the upper header beam 100 and central support beam 178. Thereafter, either the first or second angled edge portions of a ceiling section 186 are secured within the recess defined by the upper and lower flanges 180, 182 and web 184 of the first trust 176 via an adhesive. A second ceiling trust 176 is then oriented so as to capture the angled edge portion of the ceiling section 186 not disposed within the recess of the first ceiling trust 176. The second edge portion then is adhesively affixed within the recess of the second ceiling trust 176 in the same manner previously described. Subsequent ceiling sections 186 and ceiling trusts 176 are added to the roof structure 174 in the aforementioned manner.

After the ceiling trusts 176 and ceiling sections 186 have been assembled, a layer of sheathing 188 is then secured to the ceiling trusts 176, and more particularly the upper flanges 180 thereof. Thereafter, a layer of roofing material 190 is applied to the layer of sheathing 188. As seen in FIG. 19, when the sheathing 188 is applied to the upper flanges 180, a space 192 is formed between the upper plane of the ceiling sections 186 and the sheathing 188. As seen in FIG. 18, this space 192 created between the ceiling sections 186 and sheathing 188 forms an air pathway for ventilating and cooling the roof surface when eave and ridge vents are installed. Advantageously, flat, shed and gabled roofs are easily designed utilizing the roof structure 174 of the present invention. As can be appreciated, ventilation of the roof structure 174 facilitated by the air pathway carries off heat and prevents heat buildup on the roof surface thus extending the life of the layer of roofing 190. Additionally, the fresh air introduction and circulation within the roof structure 174 is provided by a natural chimney effect without electric fans and without compromising the insulation.

Due to the manner in which the floor structure 12, wall structure 42 and roof structure 174 of the present invention are pre-fabricated, all wall, flooring and roof portions of the residential structure 10 may be assembled utilizing only screw fasteners and a drill. Additionally, due to the dimensional stability associated with the pre-apertured tracks 44, 66, posts 56 and beams 98, 100 as well as the interlocking overlay of the wall panels 126, the residential structure 10 may be constructed with unskilled labor in a minimal amount of time and with a minimal amount of difficulty. In this respect, in fabricating the wall structure 42, one post 56 may be first plumbed with all other posts 56 being subsequently automatically plumbed due to the dimensional stability associated with the pre-fabricated registration means of the tracks 44, 66, i.e. the flanges 58 and track brackets 74. Further, the manner of forming the floor, wall and ceiling structures of the present invention promotes increased resistance to shear and enhanced seismic stability due to the formation of monolithic structures which take advantage of the compressive strength of the foam components thereof.

Further, those skilled in the art will recognize that the present invention takes a substantial departure from the prior art by providing a pre-fabricated, pre-apertured building system which is assembled by progressively working solely from one side of the structural posts, with all fasteners being inserted from one side of all posts. This feature permits unskilled labor and is only achieved by the high tolerance pre-fabrication of the structural building elements.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. An improved building system including a dimensionally stable, monolithic wall structure, said wall structure comprising:

an elongate, generally U-shaped track defining a bottom wall which is extended along and attached to a horizontal foundation means and opposing side walls extending upwardly from said bottom wall, said bottom wall including a plurality of preformed, linearly aligned bottom wall apertures disposed therein at predetermined locations along the track;

a plurality of elongate, vertical posts of predetermined lengths having top ends and bottom ends, said bottom ends being attached to said track at said predetermined locations along the length thereof and including recesses disposed therein to receive portions of fasteners;

at least one elongate, horizontal header beam attached to the top ends of said posts; and a plurality of pre-fabricated wall sections, each of said wall sections being disposed between a pair of adjacent posts and including first and second vertical edges which each abut a respective post of the post pair;

said posts and said wall sections being fabricated from materials having selected compressive, tensile and shear force properties so that when interacted with each other by the abutment of said first and second vertical edges of the wall sections against the posts, a monolithic wall structure is formed.

2. The device of claim 1 wherein said track further comprises a plurality of flanges extending perpendicularly upward from said bottom wall, each of said flanges including a plurality of pre-formed flange apertures disposed therein which are oriented so as to be in registry with pre-formed lower post apertures disposed in the bottom ends of each of said posts to receive fasteners to secure said posts to said track.

3. The device of claim 2 wherein said track is fabricated from sheet metal.

4. The device of claim 1 wherein each of said posts include a plurality of linearly aligned apertures disposed along the length thereof for interfacing said posts to pairs of window brackets.

5. The device of claim 1 wherein said posts and said at least one header beam are fabricated from wood.

6. An improved building system including a dimensionally stable, monolithic wall structure, said wall structure comprising:

an elongate, generally U-shaped track defining a bottom wall which is extended along and attached to a horizontal foundation means and opposing side walls extending upwardly from said bottom wall, said bottom wall including a plurality of pre-formed, linearly aligned bottom wall apertures disposed therein at predetermined locations along the track;

a plurality of elongate, vertical posts of predetermined lengths having top ends and bottom ends, said bottom ends being attached to said track at said predetermined locations along the length thereof;

a lower header attached to the top ends of said posts;

an upper header attached to said lower header; and a plurality of pre-fabricated wall sections, each of said wall sections defining:

a first vertical edge having a vertical tongue formed therealong;

a second vertical edge having a vertical slot formed therewithin which defines an interior surface;

a lower edge having a pair of parallel grooves formed therein for receiving the opposing side walls of said track; and an upper edge having a horizontal slot formed therein for receiving a portion of said lower header;

each of said wall sections being disposed between a pair of adjacent posts such that the vertical tongue thereof abuts one of the posts of the pair and the interior surface of the vertical slot thereof abuts the other post of the post pair which, together with the vertical tongue of a previously installed adjoining wall section, is received into and encapsulated by the vertical slot;

said posts and said wall section being fabricated from materials having compressive, tensile and shear force properties so that when interacted with each other by the abutment of the vertical tongues and the interior surfaces of the vertical slots of the wall sections against the posts, a monolithic wall structure is formed.

7. The device of claim 6 wherein each of saig posts is attached to said lower header via a pair of header brackets, each of said header brackets comprising;

a vertical flange portion including a pair of pre-formed vertical flange apertures disposed therein which are oriented so as to be in registry with pre-formed upper post apertures disposed in the top ends of each of said posts, said vertical flange apertures of the header bracket pair and said upper post apertures being adapted to receive fasteners to secure said header bracket pair to the top end of said post; and a horizontal flange portion including a pair of pre-formed horizontal flange apertures disposed therein which are oriented so as to be in registry with pre-formed lower header apertures to receive fasteners to secure said header bracket pair to said lower header.

8. The device of claim 7 wherein each horizontal flange portion of said pair of header brackets and said lower header further include apertures in registry with each other and with a pair of pre-formed upper header apertures to receive fasteners to secure said upper header to said lower header.

9. The device of claim 6 wherein each of said wall sections is fabricated from polystyrene foam.

10. The device of claim 9 wherein the vertical tongues and vertical slots of each of said wall sections include a vertical groove formed therein for receiving foam to form an expanded foam seal between the vertical tongue and one post of the post pair and the vertical slot and the other post of the post pair to form a monolithic wall structure.

11. An improved building system including a dimensionally stable, monolithic wall structure, said wall structure comprising:

an elongate track which is extended along and attached to a horizontal foundation means;

a plurality of elongate, vertical posts of predetermined lengths having top and bottom ends, said bottom ends being attached to said track at predetermined locations along the length thereof;

at least one, horizontal header beam attached to the top ends of said posts; and a plurality of pre-fabricated wall sections, each of said wall sections defining:

a first vertical edge having a vertical tongue formed therealong; and a second vertical edge having a vertical slot formed therewithin which defines an interior surface;

each of said wall sections being disposed between a pair of adjacent posts such that the vertical tongue thereof abuts one of the posts of the pair and the interior surface of the vertical slot thereof abuts the other post of the post pair which, together with the vertical tongue of a previously installed adjoining wall section, is received into and encapsulated by the vertical slot;

said posts and said wall sections being fabricated from materials having selected compressive, tensile and shear force properties so that when interacted with each other by the abutment of the vertical tongues and the interior surfaces of the vertical slots of the wall sections against the posts, a monolithic wall structure is formed.

12. The device of claim 11 wherein the vertical tongue and interior surface of the vertical slot of each of said wall sections includes a vertical groove formed therein for receiving foam to form an expanded foam seal between the vertical tongue and one post of the post pair and the interior surface of the vertical slot and the other post of the post pair to form a monolithic wall structure.

13. The device of claim 12 wherein each of said wall sections is fabricated from polystyrene foam.

14. The device of claim 11 wherein said track has a generally U-shaped configuration defining a bottom wall which is extended along and attached to said foundation means and opposing side walls extending upwardly from said bottom wall, and said wall section further defines a lower edge having a pair of parallel grooves formed therein for receiving the opposing side walls of said track.

15. The device of claim 14 wherein each of said wall sections further defines an upper edge having a horizontal slot formed therein for receiving at least a portion of said header beam.

16. The device of claim 14 wherein said bottom wall of said track includes a plurality of pre-formed linearly aligned bottom wall apertures disposed therein.

17. The device of claim 16 wherein the opposing side walls of said track include pairs of V-shaped notches disposed therein for placing a drilling jig in vertical registry with said bottom wall apertures.

18. The device of claim 11 wherein the bottom ends of said posts include recesses disposed therein.

19. The device of claim 11 wherein said at least one horizontal header beam comprises a lower header attached to the top ends of said posts and an upper header attached to said lower header.

* * * * *